US009573738B1

(12) United States Patent
Lai

(10) Patent No.: US 9,573,738 B1
(45) Date of Patent: Feb. 21, 2017

(54) BEVERAGE CONTAINER CAP

(71) Applicant: SARA ROSE INTERNATIONAL INC., New Taipei (TW)

(72) Inventor: James Lai, New Taipei (TW)

(73) Assignee: SARA ROSE INTERNATIONAL INC., New Taipei (TW)

( * ) Notice: Subject to any disclaimer, the term of this patent is extended or adjusted under 35 U.S.C. 154(b) by 0 days.

(21) Appl. No.: 14/757,452

(22) Filed: Dec. 23, 2015

(51) Int. Cl.

| | |
|---|---|
| ***A47G 19/22*** | (2006.01) |
| ***B65D 47/06*** | (2006.01) |
| ***B65D 83/00*** | (2006.01) |
| ***B65D 47/30*** | (2006.01) |
| ***B65D 47/24*** | (2006.01) |
| ***B65D 53/02*** | (2006.01) |
| *B65D 47/32* | (2006.01) |

(52) U.S. Cl.
CPC ..... *B65D 47/24* (2013.01); *B65D 47/065* (2013.01); *B65D 53/02* (2013.01); *A47G 19/2272* (2013.01); *B65D 47/305* (2013.01); *B65D 47/32* (2013.01)

(58) Field of Classification Search
CPC ..... B65D 47/24; B65D 47/065; B65D 47/305; B65D 47/32; B65D 53/02; A47G 19/2272
See application file for complete search history.

(56) References Cited

U.S. PATENT DOCUMENTS 3,089,626 A * 5/1963 Kubiliunas ..... B65D 47/305 222/484
3,542,256 A * 11/1970 Waterman ..... B65D 47/305 222/484
3,718,238 A * 2/1973 Hazard ..... B65D 47/305 222/536
4,219,138 A * 8/1980 Hazard ..... B65D 47/305 222/534
5,065,909 A * 11/1991 Pino ..... B65D 47/305 215/229
5,477,994 A * 12/1995 Feer ..... B65D 47/305 137/846
6,390,341 B1 * 5/2002 Ohmi ..... B65D 47/0809 222/182
D547,607 S 7/2007 Forsman
7,533,783 B2 5/2009 Choi et al.
D653,081 S 1/2012 George
8,191,727 B2 6/2012 Davies et al.
8,215,511 B1 * 7/2012 Lin ..... B65D 39/08 215/228

(Continued)

*Primary Examiner* — Frederick C Nicolas
(74) *Attorney, Agent, or Firm* — Muncy, Geissler, Olds & Lowe, P.C.

(57) ABSTRACT

A beverage container cap is revealed. The beverage container cap includes a cap body movably disposed on top of a beverage container, a waterproof gasket fixed on bottom of a valve seat with a chamber, and a pivot valve mounted in the chamber of the valve seat. A liquid through hole and at least one vent are arranged at the waterproof gasket. When a hemispherical pivot part of the pivot valve is pivotally rotated within the chamber of the valve seat to make the beverage container cap in a closed or open state, at least one lug on the hemispherical pivot part is pressed against or away from the vent of the waterproof gasket. Thereby pressure in the beverage container is equal to the pressure of the atmosphere outside while beverage in the container flows out. Thus users can drink the beverage from the container smoothly.

9 Claims, 8 Drawing Sheets

(56) References Cited

U.S. PATENT DOCUMENTS

| | | | | |
|---|---|---|---|---|
| 8,276,776 | B2 | 10/2012 | Roth et al. | |
| 8,469,226 | B2 | 6/2013 | Davies et al. | |
| D688,093 | S | 8/2013 | Roth et al. | |
| 8,622,237 | B2 | 1/2014 | Choi et al. | |
| 8,668,106 | B1 * | 3/2014 | Joy | A47G 19/2266 220/254.3 |
| 8,672,174 | B1 * | 3/2014 | McMullin | A47G 21/18 215/229 |
| 8,777,048 | B2 | 7/2014 | Choi et al. | |
| 2004/0217139 | A1 * | 11/2004 | Roth | A45F 3/18 224/148.7 |
| 2012/0181277 | A1 * | 7/2012 | Wang-Wu | B65D 47/305 220/212 |
| 2012/0181303 | A1 * | 7/2012 | Swanick | B65D 47/32 222/83 |
| 2012/0234789 | A1 * | 9/2012 | Mason | B65D 77/28 215/229 |

* cited by examiner

BEVERAGE CONTAINER CAP

BACKGROUND OF THE INVENTION

The present invention relates to a beverage container cap, especially to a beverage container cap that includes a pivot valve and a waterproof gasket used in combination with each other to form a closed state and an open state. A liquid through hole and at least one vent are formed integrally on the waterproof gasket.

There is a portable beverage container available on the market. The beverage container is disposed with a cap easily operated to switch between a closed state and an open state, such as the cap revealed in U.S. Pat. No. D653,081, U.S. Pat. No. D688,093, U.S. Pat. No. 8,276,776, U.S. Pat. No. D547,607, U.S. Pat. No. 7,533,783, U.S. Pat. No. 8,191,727, U.S. Pat. No. 8,469,226, U.S. Pat. No. 8,622,237, U.S. Pat. No. 8,777,048, etc. The cap mentioned above mainly includes a cap body, a waterproof gasket, and a pivot valve. These parts are formed integrally by injection molding or extrusion molding. The waterproof gasket is made from flexible resin such as silicone while the cap or pivot valve is made from hard plastic material. The waterproof gasket and its mold are produced apart from the cap/or the pivot valve.

Take the cap revealed in U.S. Pat. No. D653,081 as an example. A liquid hole of the waterproof gasket is correspondingly fitted on a fluid hole of the cap while the pivot valve is tightly pressed against the liquid hole of the waterproof gasket and is able to be rotated pivotally and switched between a closed position and an open position. Thereby users can operate the pivot valve to switch from the closed state (not allowing users to drink) to the open state (allowing users to drink), or vice versa.

However, the above cap has the following disadvantages while in use. First the cap is arranged with a fluid hole and a vent hole. Thus pressure in the container is equal to the pressure of the atmosphere outside while fluid in the container flows out and users can drink fluid in the container smoothly. The fluid hole of the cap is directly corresponding to the liquid hole of the waterproof gasket and is opened/or closed by the pivot valve. Once the cap is further arranged with a vent hole, another special waterproof gasket for the vent hole is required. The special waterproof gasket for the vent hole is closed or opened along with the pivot valve. Thus not only production cost (such as the mold) is increased, the cost of installation is also raised. Moreover, the waterproof gasket for the vent hole has a smaller size. Thus it's not only difficult to install but also easy to fall off in use. There is a choking risk once the user swallows the small waterproof gasket. There is room for improvement and a need to provide a cap with new structure.

SUMMARY OF THE INVENTION

Therefore it is a primary object of the present invention to provide a beverage container cap that includes a pivot valve and a waterproof gasket used in combination with each other to form a close state or an open state. A liquid through hole and at least one vent are formed integrally on the waterproof gasket. Thus the cost for manufacturing a special waterproof gasket for a vent hole of a conventional cap with a pivot valve can be saved. The special waterproof gasket is not only difficult to be assembled on the vent hole of the cap but also easy to be detached and swallowed. Moreover, the efficiency of the cap is improved.

In order to achieve the above object, a beverage container cap of the present invention includes a cap body, a pivot valve and a waterproof gasket. The cap body is movably disposed on an opening on top of a beverage container. A valve seat with a chamber is arranged at a top surface of the cap body while a fluid through hole is set on bottom of the chamber, penetrating the cap body and communicating with an inner space of the beverage container. At least one vent hole is arranged around the fluid through hole.

The waterproof gasket is fixed on the fluid through hole on bottom of the chamber and including a liquid through hole corresponding to and communicating with the fluid through hole on bottom of the chamber of the cap body. At least one vent is disposed around the liquid through hole while the vent is corresponding to and communicating with the vent hole on bottom of the chamber of the cap body. The pivot valve is pivotally connected to and mounted in the chamber of the valve seat and including a hemispherical pivot part and a nozzle part. The hemispherical pivot part is located on bottom of the pivot valve and having a hemispherical surface while the nozzle part is formed by extension of the hemispherical pivot part. The hemispherical surface is tightly pressed against the liquid through hole of the waterproof gasket and is switched between a first pivot position and a second pivot position along with the movement of the pivot valve. A flow channel is disposed inside the nozzle part and two ends of the flow channel form a water inlet and a water outlet respectively. The water inlet is located at the hemispherical surface of the pivot part while the water outlet is located at one end of the nozzle part opposite to the end of the nozzle part with the pivot part. At least one lug is disposed around the hemispherical surface.

The water inlet on the hemispherical surface of the pivot valve is away from the liquid through hole of the waterproof gasket and the hemispherical surface is pressed against the liquid through hole of the waterproof gasket tightly when the pivot valve is pivotally rotated to the first pivot position. At the same time, the lug around the hemispherical surface of the pivot valve is closely pressed against the vent of the waterproof gasket. Thus the beverage container cap is in a closed state. The water inlet on the hemispherical surface of the pivot valve is aligned with and communicating with the liquid through hole of the waterproof gasket when the pivot valve is pivotally rotated to the second pivot position. At the same time, the lug around the hemispherical surface is away from the vent of the waterproof gasket and the vent hole of the cap body is communicating with the outside through the vent of the waterproof gasket. Thus the beverage container cap is in an open state.

DETAILED DESCRIPTION OF THE PREFERRED EMBODIMENT

Figure 1:
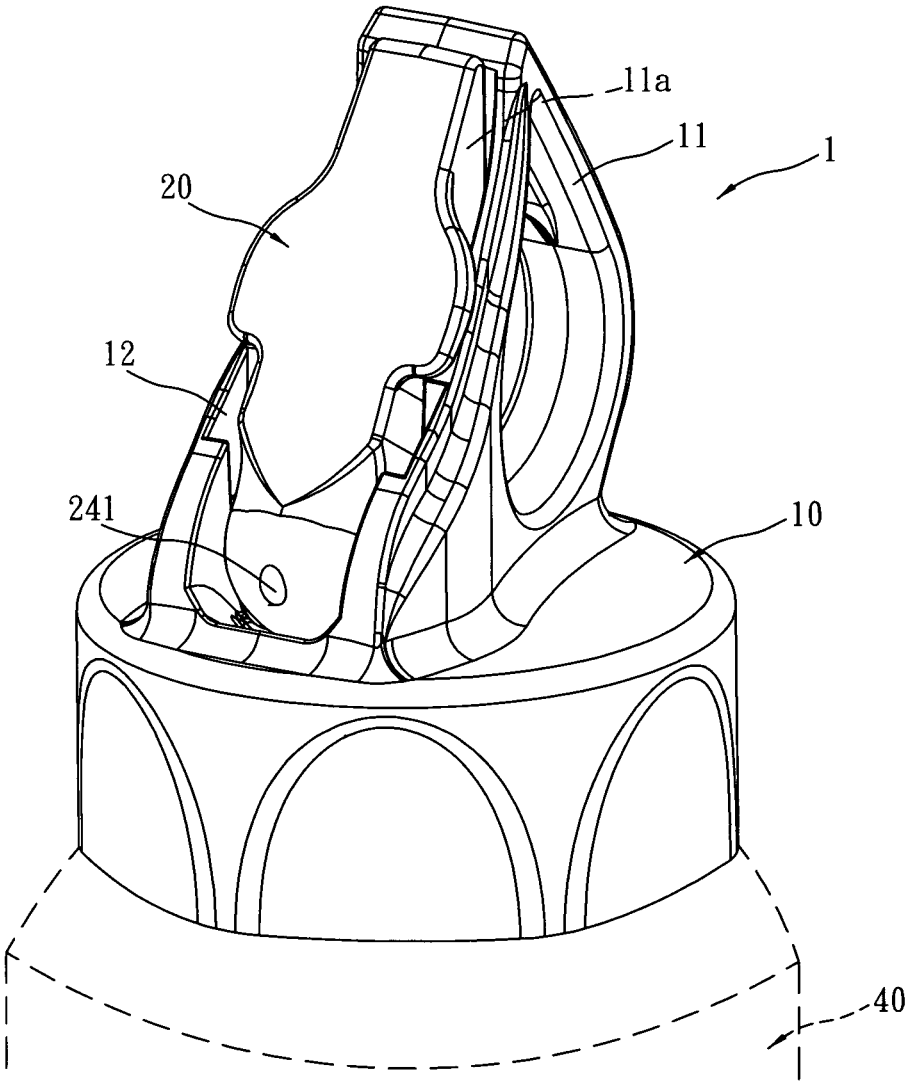
FIG. 1 is a perspective view of an embodiment in a closed state according to the present invention.
Figure 2:
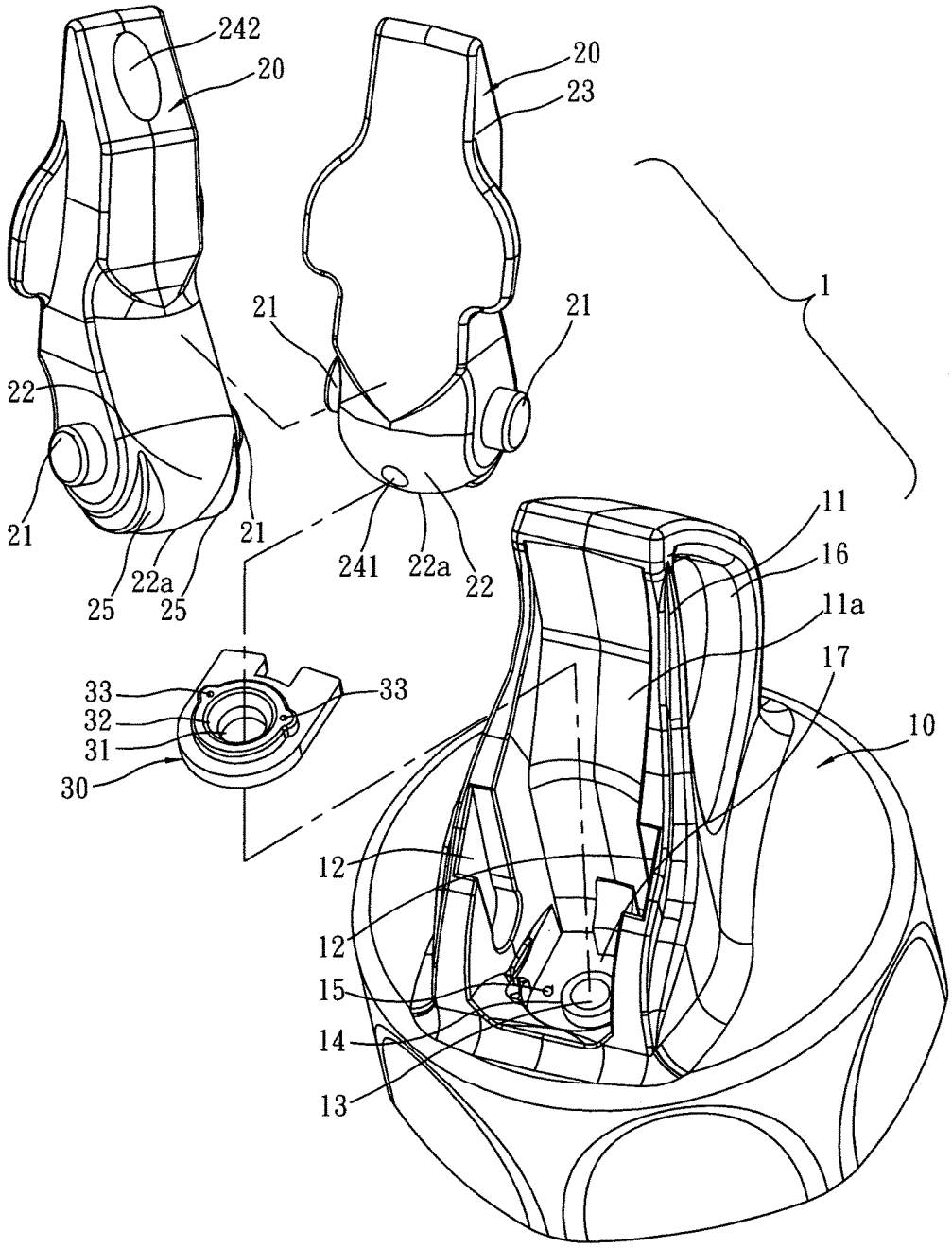
FIG. 2 is an explosive view of the embodiment in FIG. 1 with a pivot valve viewed from different angles according to the present invention.

Refer to FIG. 1 and FIG. 2, a beverage container cap 1 of the present invention includes a cap body 10, a pivot valve 20 and a waterproof gasket 30. The cap body 10 and the pivot valve 20 are integrally formed by plastic injection molding respectively while the waterproof gasket 30 is one piece made from flexible material such as silicone.

The cap body 10 is movably disposed on an opening on top of a beverage container 40. A valve seat 11 with a chamber 11*a* is arranged at and projecting upward from a top surface of the cap body 10, as shown from FIG. 1 to FIG. 10. The valve seat 11 can also be mounted and indented downward in the top surface of the cap body 10, as shown from FIG. 11 to FIG. 13.

The shape and space of the chamber 11*a* is designed to be fitted with the pivot valve 20. Take the beverage container cap 1 in FIG. 1 and FIG. 2 as an example. A fluid through hole 13 is set on bottom of the chamber 11*a*, penetrating the cap body 10 and communicating with an inner space of the beverage container 40. The fluid through hole 13 includes a fluid through-hole flange 14 and at least one vent hole 15 is set around the fluid through-hole flange 14.

The waterproof gasket 30 is aligned with and fixed on the fluid through hole 13 or the fluid through-hole flange 14 on bottom of the chamber 11*a* correspondingly, as shown in FIG. 2. The waterproof gasket 30 consists of a liquid through hole 31, a liquid through-hole flange 32, and at least one vent 33. The liquid through hole 31 is communicating with the fluid through hole 13 of the cap body 10 correspondingly and the vent 33 is disposed around the liquid through-hole flange 32. The vent 33 is corresponding to and communicating with the vent hole 15 located around the fluid through-hole flange 14 of the cap body 10. In FIG. 2, there are two vents 33 set on the right side and the left side of the liquid through-hole flange 32 respectively. The number of the vent 33 is not limited. One of the features of the present invention is that the waterproof gasket 30 is disposed with one liquid through hole 31 and at least one vent 33.

The pivot valve 20 is pivotally connected to and mounted in the chamber 11*a* of the valve seat 11, as shown in FIG. 1 and FIG. 2. A pivot shaft 21 is disposed on each of the two opposite side surfaces (left side and right side) of the pivot valve 20 for being pivotally connected to a pivot slot 12 on each of two corresponding inner walls (left side wall and right side wall) of the chamber 11*a* of the valve seat 11. Thereby the pivot valve 20 is pivotally rotated within a certain angle between a closed state at a first pivot position (as shown in FIG. 1, FIG. 4 to FIG. 6) and an open state at a second pivot position (as shown from FIG. 7 to FIG. 10) in the chamber 11*a* of the valve seat 11.

Figure 4:
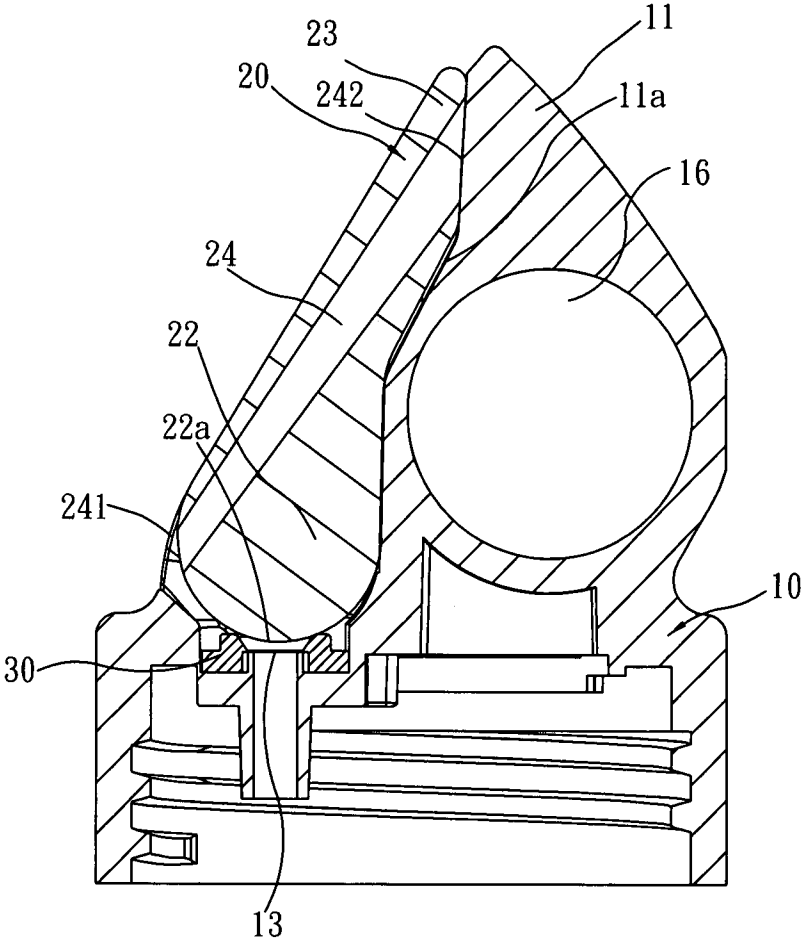
FIG. 4 is a cross sectional view taken along line "4-4" of the embodiment in FIG. 3 according to the present invention.
Figure 3:
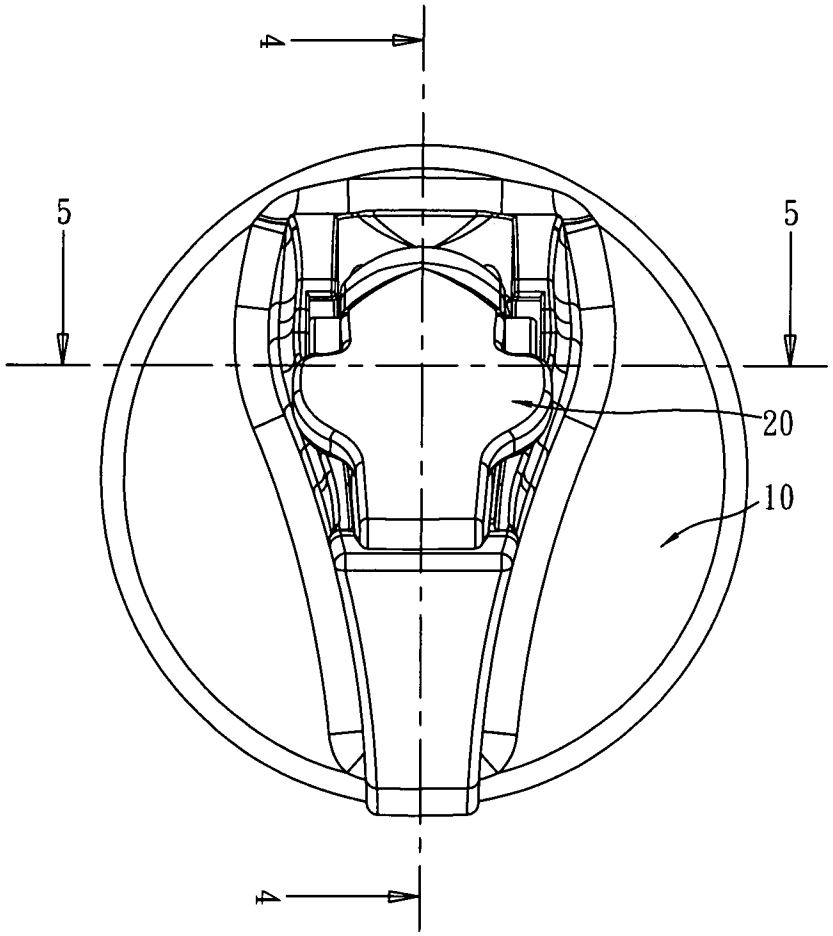
FIG. 3 is a top view of the embodiment in FIG. 1 according to the present invention.
Figure 6:
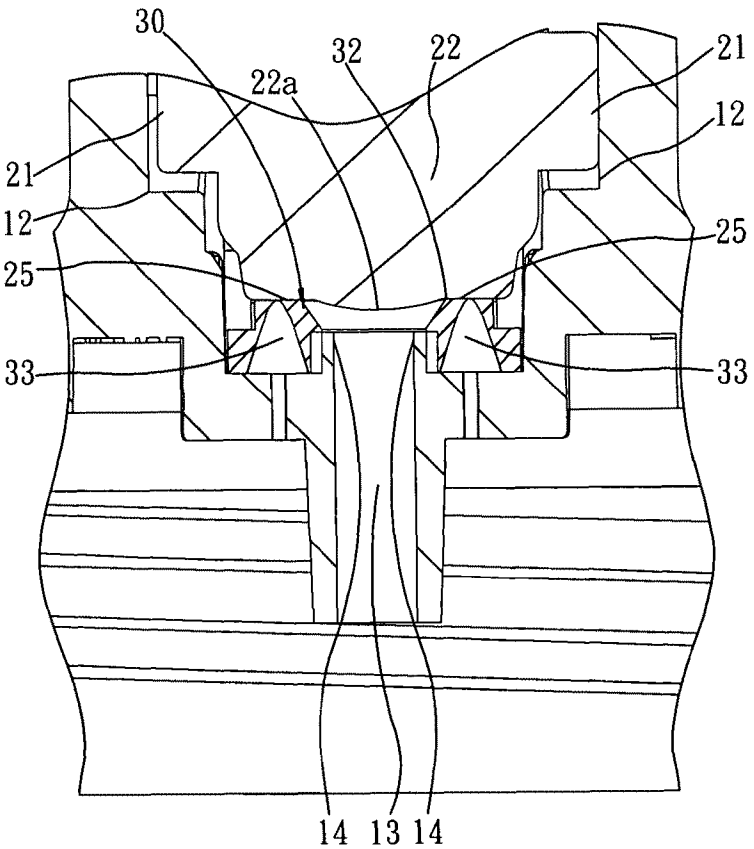
FIG. 6 is a partial enlarged view of a waterproof gasket of the embodiment in FIG. 5 according to the present invention.
Figure 5:
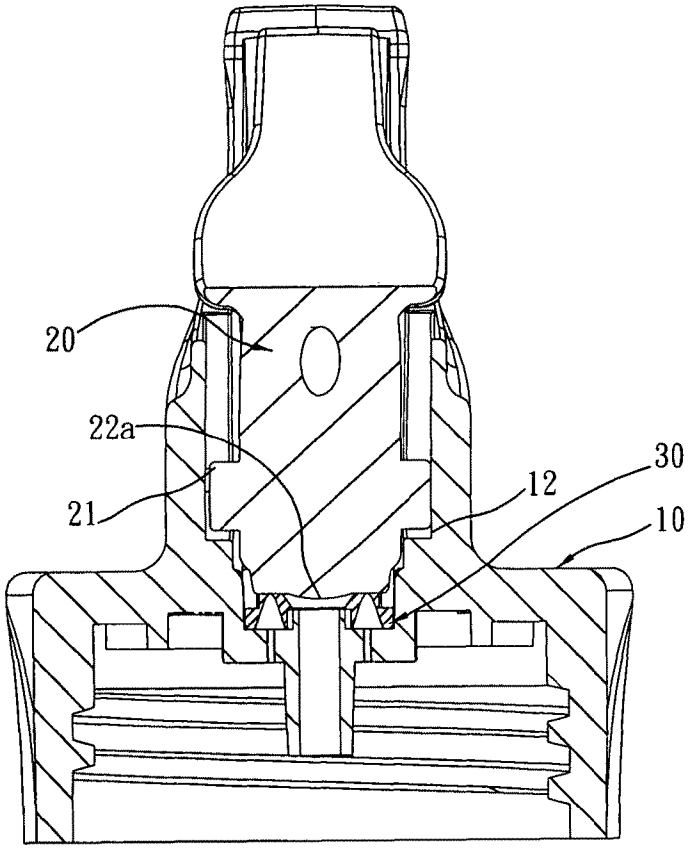
FIG. 5 is a cross sectional view taken along line "5-5" of the embodiment in FIG. 3 according to the present invention.
Figure 8:
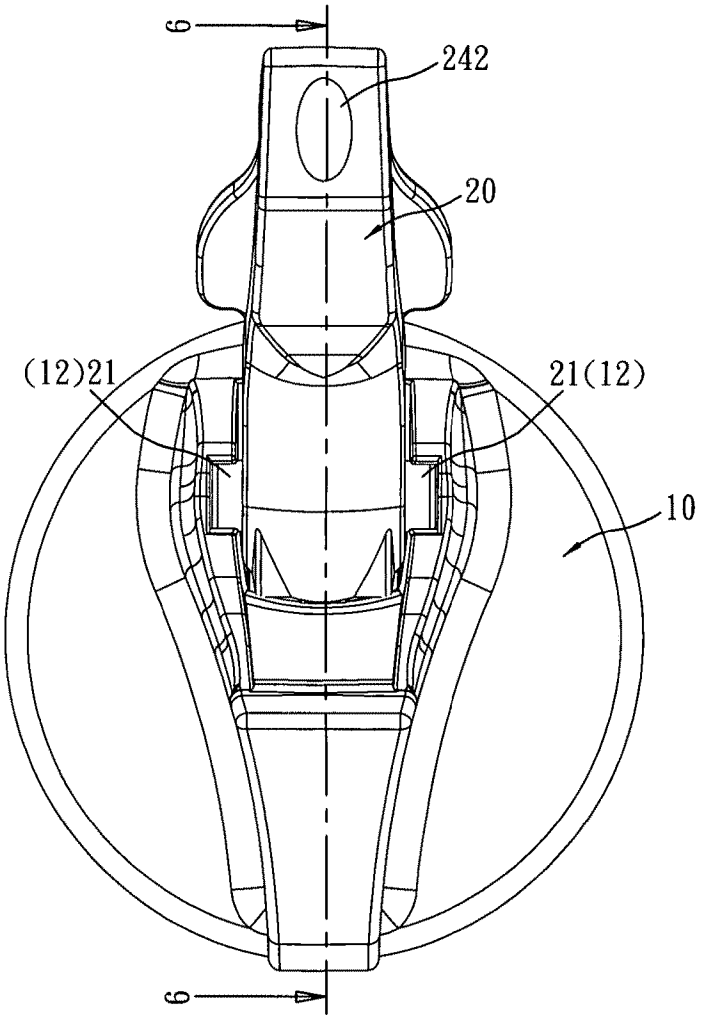
FIG. 8 is a top view of the embodiment in FIG. 7 according to the present invention.
Figure 7:
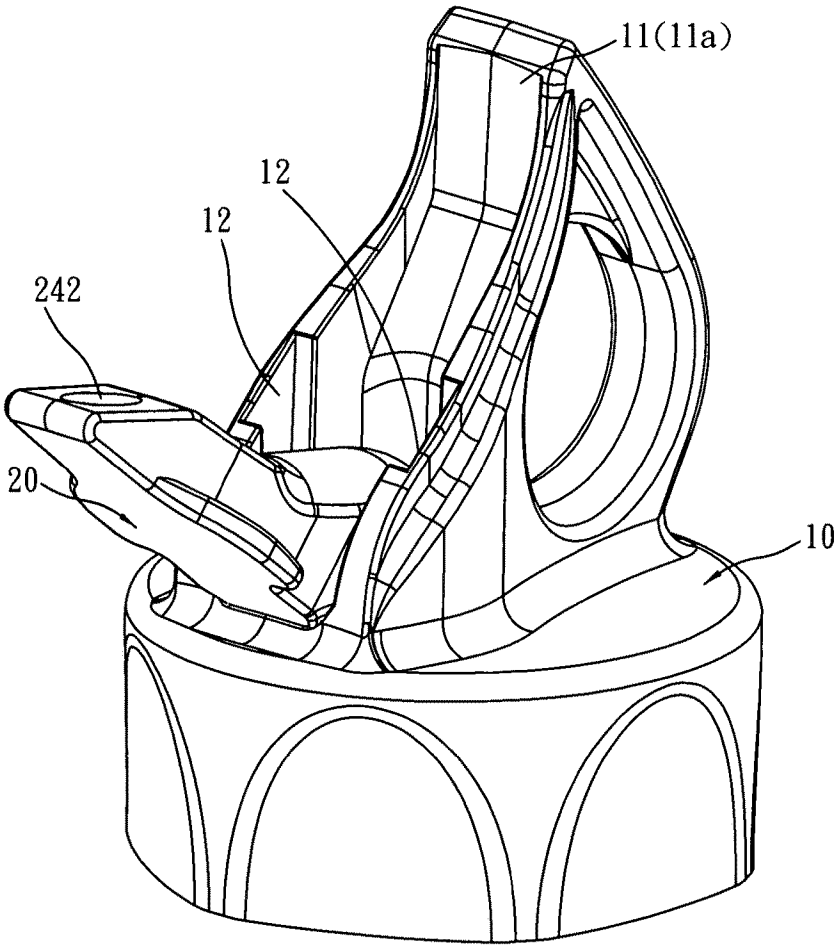
FIG. 7 is a perspective view of a pivot valve of the embodiment in FIG. 1 pivoted to an open state according to the present invention.

As show in FIG. 2, the pivot valve 20 further includes a hemispherical pivot part 22, a nozzle part 23, a flow channel 24 and at least one lug 25. The hemispherical pivot part 22 is located on bottom of the pivot valve 20 and having a hemispherical surface 22*a* pressed against the liquid through hole 31/liquid through-hole flange 32 of the waterproof gasket 30. The nozzle part 23 is formed by extension of the hemispherical pivot part 22. The hemispherical surface 22*a* can be switched between the closed state at the first pivot position and the open state at the second pivot position along with the movement of the pivot valve 20. As shown in FIG. 4, the flow channel 24 is disposed inside the nozzle part 23. The two ends of the flow channel 24 form a water inlet 241 and a water outlet 242 respectively. The water inlet 241 is located at the hemispherical surface 22*a* of the pivot part 22 while the water outlet 242 is located at one end of the nozzle part 23 opposite to the end of the nozzle part 23 with the pivot part 22, allowing users to drink.

As shown in FIG. 2, at least one lug 25 is disposed around the hemispherical surface 22*a* of the hemispherical pivot part 22. The lug 25 is pivotally rotated along with the hemispherical surface 22*a* and the hemispherical pivot part 22 to press against and close the vent 33 of the waterproof gasket 30 tightly (as shown in FIG. 1, and FIG. 4-6). Or the lug 25 is pivotally rotated to be away from the vent 33 of the waterproof gasket 30 and the vent 33 is in an open state (as shown in FIG. 7-10). This is one of the main technical features of the present invention.

Refer to FIG. 1, FIG. 4 to FIG. 6, the water inlet 241 on the hemispherical surface 22*a* of the pivot valve 20 is away from the liquid through hole 31 (the liquid through-hole flange 32) of the waterproof gasket 30 and the hemispherical surface 22*a* is closely pressed against the liquid through hole 31 of the waterproof gasket 30 when the pivot valve 20 is pivotally rotated to the first pivot position. At the same time, the lug 25 around the hemispherical surface 22*a* of the pivot valve 20 is pressed against the vent 33 of the waterproof gasket 30 tightly. Thus the beverage container cap 1 is in a closed state.

Figure 10:
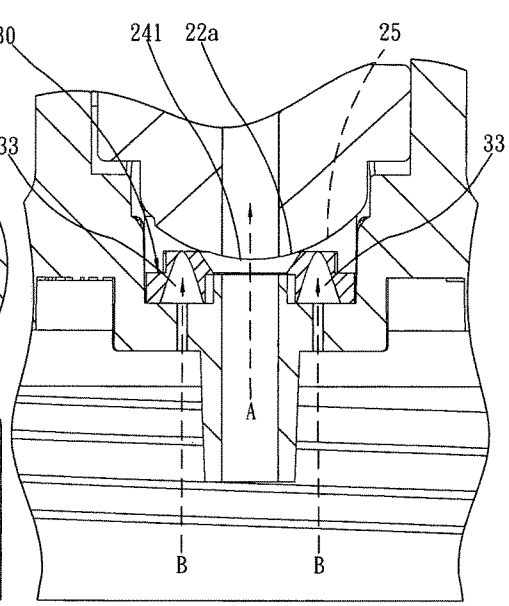
FIG. 10 is a partial enlarged view of a waterproof gasket of the embodiment in FIG. 9 according to the present invention.
Figure 9:
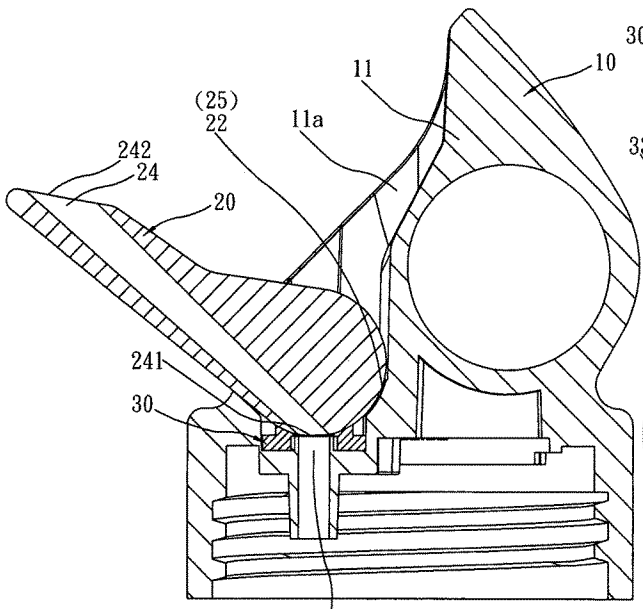
FIG. 9 is a cross sectional view taken along line "9-9" of the embodiment in FIG. 8 according to the present invention.

When the pivot valve 20 is pivotally rotated to the second pivot position (as shown from FIG. 7 to FIG. 10), the water inlet 241 on the hemispherical surface 22*a* of the pivot valve 20 is aligned with and communicating with the liquid through hole 31 of the waterproof gasket 30, as the arrow A indicates in FIG. 10. At the same time, the lug 25 around the hemispherical surface 22*a* is away from the vent 33 of the waterproof gasket 30 and the vent hole 15 of the cap body 10 is communicating with the outside through the vent 33 of the waterproof gasket 30. Thus the beverage container cap 1 is in an open state, as the arrow B indicates in FIG. 10. At the moment, the pressure inside the beverage container 40 is equal to the pressure of the atmosphere outside. Thus fluid in the beverage container 40 flows through the fluid through hole 13 of the cap body 10, the liquid through hole 31 of the waterproof gasket 30, the water inlet 241, and the flow channel 24, and the water outlet 242 to be consumed by the user. Thus the user can drink the beverage from the beverage container 40 smoothly.

Figure 12:
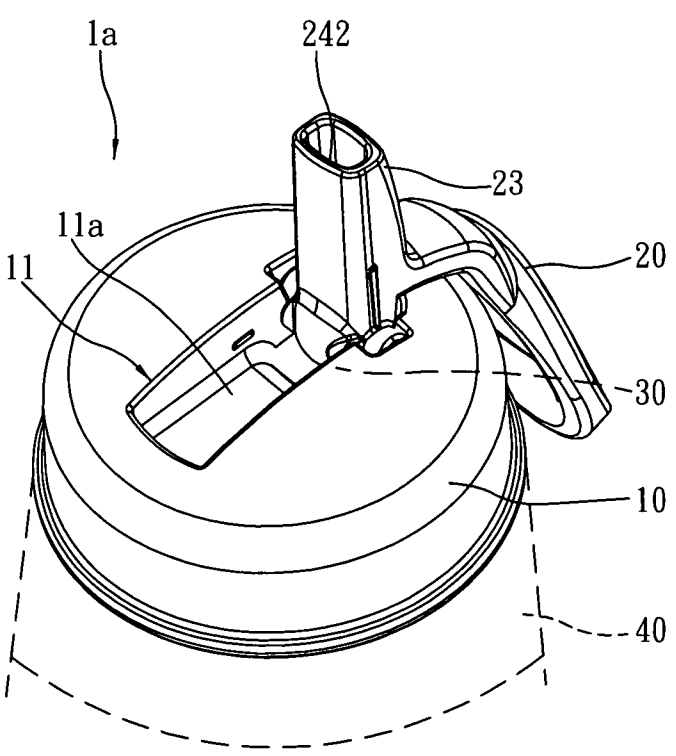
FIG. 12 is a perspective view of another embodiment in an open state according to the present invention.
Figure 11:
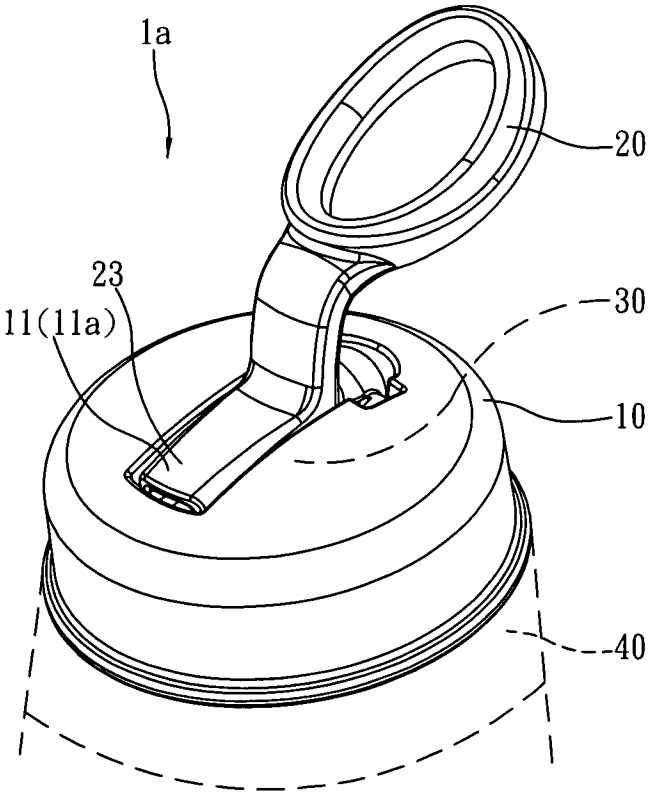
FIG. 11 is a perspective view of another embodiment in a closed state according to the present invention.
Figure 13:
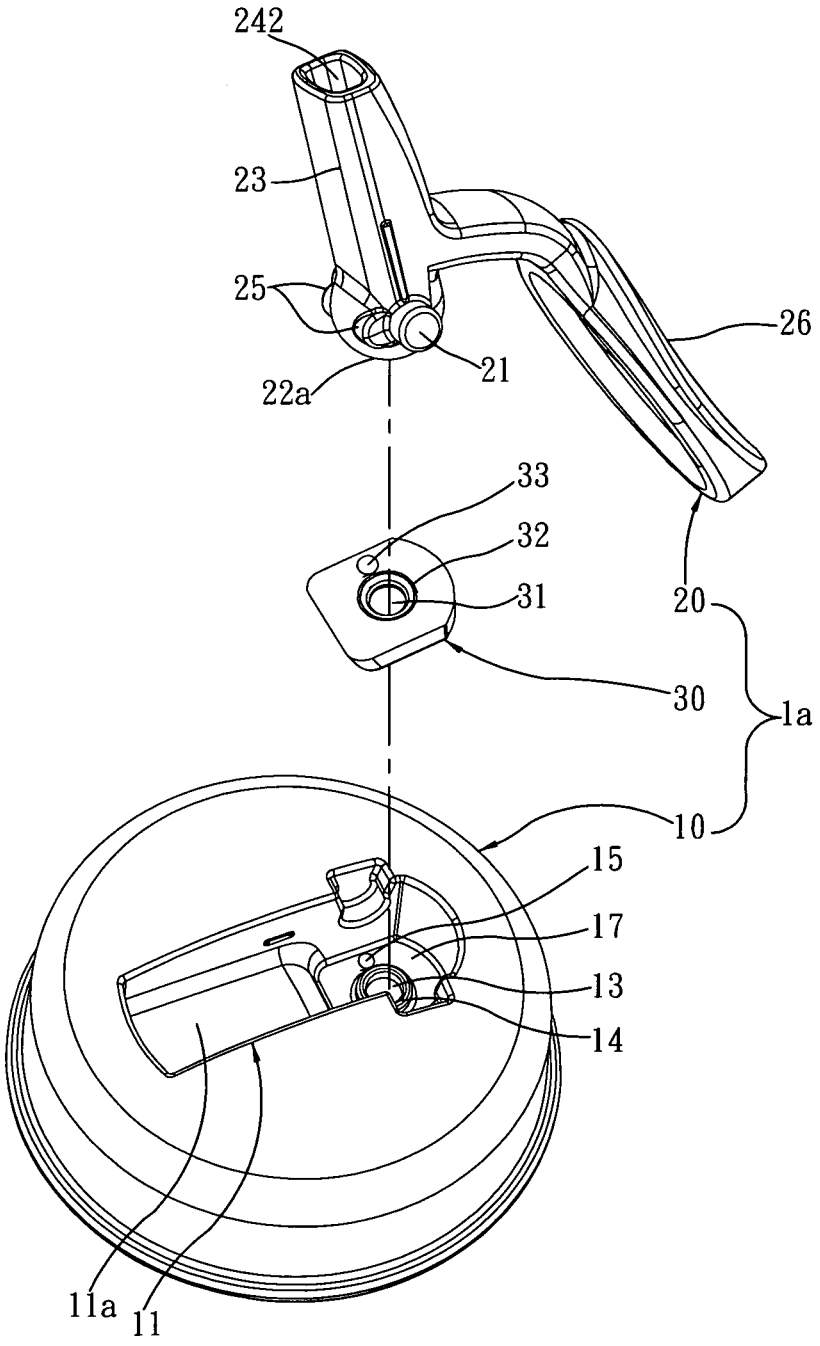
FIG. 13 is an explosive view of the embodiment in FIG. 11 according to the present invention.

Refer to FIG. 11, FIG. 12 and FIG. 13, another embodiment of the present invention is revealed. This embodiment has similar structure as the above beverage container cap 1 shown in FIG. 1-10. A liquid through hole 31 and at least one vent 33 are disposed on a waterproof gasket 30. At least one lug 25 is arranged around a hemispherical surface 22*a* of a hemispherical pivot part and is pivotally rotated to press against or come away from the vent 33 of the waterproof gasket 30. Thus the beverage container cap 1 is in a closed state or an open state. The difference between this embodiment and the above one is in that a cap body 10 (including a valve seat 11 and a chamber 11*a*) and a pivot valve 20 of this embodiment have different designs. The valve seat 11 of the beverage container cap 1 is projecting from the top surface of the cap body 10 and located above the top surface of the cap body 10, as shown in FIG. 1-10. As to the valve seat 11 of the beverage container cap 1*a*, it is mounted in the cap body 10 and located under the top surface of the cap body 10, as shown in FIG. 11-13.

Moreover, as shown in FIG. 1 and FIG. 2, the valve seat 11 further includes a ring-type handle 16 formed on an outer surface thereof and opposite to the chamber 11*a* thereof Refer to FIG. 13, the pivot valve 2 further includes a ring-type handle 26 formed by extension of the pivot part 22 and separated from the nozzle part 23. There is a certain angle between the ring-type handle 26 and the nozzle part 23.

Furthermore, in order to allow easy assembly and positioning of the waterproof gasket 30 on the valve seat 11 (chamber 11*a*) of the cap body 10, a circular groove 17 is arranged at the bottom of the chamber 11*a* of the valve seat 11. The circular groove 17 is used for mounting and fixing the waterproof gasket 30.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A beverage container cap comprising:

a cap body that is movably disposed on an opening on top of a beverage container; the cap body having a valve seat with a chamber on a top surface thereof, a fluid through hole set on bottom of the chamber, penetrating therethrough and communicating with an inner space of the beverage container, and at least one vent hole arranged around the fluid through hole;

a waterproof gasket fixed on the fluid through hole on bottom of the chamber; the waterproof gasket having a liquid through hole corresponding to and communicating with the fluid through hole on bottom of the chamber of the cap body, and at least one vent arranged around the liquid through hole, corresponding to and communicating with the vent hole of the cap body; and a pivot valve pivotally connected to and mounted in the chamber of the valve seat and including a hemispherical pivot part located on bottom of the pivot valve and a nozzle part formed by extension of the hemispherical pivot part; the hemispherical pivot part having a hemispherical surface; wherein the hemispherical surface is tightly pressed against the liquid through hole of the waterproof gasket and is switched between a first pivot position and a second pivot position along with movement of the pivot valve; a flow channel is disposed inside the nozzle part and two ends of the flow channel form a water inlet and a water outlet respectively while the water inlet is located at the hemispherical surface of the pivot part while the water outlet is located at one end of the nozzle part opposite to the end of the nozzle part with the pivot part; at least one lug is disposed around the hemispherical surface;

wherein the water inlet on the hemispherical surface of the pivot valve is away from the liquid through hole of the waterproof gasket and the hemispherical surface is pressed against the liquid through hole of the waterproof gasket tightly when the pivot valve is pivotally rotated to the first pivot position; at the same time, the lug around the hemispherical surface is closely pressed against the vent of the waterproof gasket so that the beverage container cap is in a closed state;

wherein the water inlet on the hemispherical surface of the pivot valve is aligned with and communicating with the liquid through hole of the waterproof gasket when the pivot valve is pivotally rotated to the second pivot position; at the same time, the lug around the hemispherical surface is away from the vent of the waterproof gasket and the vent hole of the cap body is communicating with the outside through the vent of the waterproof gasket so that the beverage container cap is in an open state.

2. The device as claimed in claim 1, wherein the cap body and the pivot valve are integrally formed by plastic injection molding respectively.

3. The device as claimed in claim 1, wherein the waterproof gasket is integrally formed and made from silicone.

4. The device as claimed in claim 1, wherein a pivot slot is disposed on each of two corresponding inner walls of the chamber of the valve seat and a pivot shaft is arranged at each of two opposite side surfaces of the pivot valve for being pivotally connected to the pivot slot correspondingly.

5. The device as claimed in claim 1, wherein the valve seat is projecting from the top surface of the cap body and located above the top surface of the cap body.

6. The device as claimed in claim 1, wherein the valve seat is indented downward in the top surface of the cap body and located under the top surface of the cap body.

7. The device as claimed in claim 1, wherein the valve seat further includes a ring-type handle formed on an outer surface of the chamber thereof.

8. The device as claimed in claim 1, wherein the pivot valve further includes a ring-type handle formed by extension of the pivot part and separated from the nozzle part.

9. The device as claimed in claim 1, wherein a circular groove for mounting and fixing the waterproof gasket is arranged at the bottom of the chamber of the valve seat.

* * * * *